US007805941B2

(12) United States Patent
Gobrecht et al.

(10) Patent No.: US 7,805,941 B2
(45) Date of Patent: Oct. 5, 2010

(54) METHOD FOR STARTING A STEAM TURBINE INSTALLATION

(75) Inventors: Edwin Gobrecht, Ratingen (DE); Rainer Quinkertz, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 112 days.

(21) Appl. No.: 11/988,605

(22) PCT Filed: Jun. 13, 2006

(86) PCT No.: PCT/EP2006/063135

§ 371 (c)(1),
(2), (4) Date: Jan. 11, 2008

(87) PCT Pub. No.: WO2007/006617

PCT Pub. Date: Jan. 18, 2007

(65) Prior Publication Data

US 2009/0126365 A1 May 21, 2009

(30) Foreign Application Priority Data

Jul. 14, 2005 (DE) ..... 05015350.1

(51) Int. Cl.
*F01K 13/02* (2006.01)
*F01K 21/06* (2006.01)

(52) U.S. Cl. ..... 60/646; 60/656; 60/660

(58) Field of Classification Search ..... 60/646, 60/656–658, 660, 664, 653; 122/406.5
See application file for complete search history.

(56) References Cited

U.S. PATENT DOCUMENTS 3,358,450 A * 12/1967 Schroedter et al. ..... 60/646
3,524,592 A * 8/1970 Gustafsson ..... 239/466
3,532,079 A 10/1970 Chamberet
4,208,882 A 6/1980 Carberg et al.
4,226,086 A * 10/1980 Binstock et al. ..... 60/656
4,282,708 A * 8/1981 Kuribayashi et al. ..... 60/778
4,320,625 A * 3/1982 Westphal et al. ..... 60/646

(Continued)

FOREIGN PATENT DOCUMENTS

JP 58047105 A 3/1983

OTHER PUBLICATIONS

Prof. Dr. Dolezal; Anfahren eines auf 550° C. erhitzen Durlauf-Abhitzekessels; S. 1163 bis 1166; VGB Kraftwerkstechnik 69; 12; Magazine; 1989; DE.

*Primary Examiner*—Thomas E Denion
*Assistant Examiner*—Christopher Jetton

(57) ABSTRACT

The invention relates to a method for starting a steam turbine installation which comprises at least one steam turbine and at least one steam-generating installation for generating steam for driving the steam turbines, the steam turbine installation having at least one casing component, which has an initial starting temperature of more than 250° C., the temperature of the steam and of the casing component being continually measured, and the casing component of the steam turbine installation being supplied with steam from the starting time point onwards. The starting temperature of the steam is lower than the temperature of the casing component and the temperature of the steam is increased with a start transient and the staring temperature is chosen such that the change in temperature per unit of time of the casing component lies below a predefined limit. The temperature of the casing component initially decreases, until a minimum is reached and then increases.

14 Claims, 2 Drawing Sheets

U.S. PATENT DOCUMENTS 4,455,836 A * 6/1984 Binstock et al. ..... 60/663
4,589,255 A * 5/1986 Martens et al. ..... 60/646
5,018,356 A * 5/1991 Silvestri et al. ..... 60/646
5,046,318 A * 9/1991 Hwang et al. ..... 60/646
5,433,079 A * 7/1995 Badami et al. ..... 60/660

* cited by examiner

METHOD FOR STARTING A STEAM TURBINE INSTALLATION

CROSS REFERENCE TO RELATED APPLICATIONS

This application is the US National Stage of International Application No. PCT/EP2006/063135, filed Jun. 13, 2006 and claims the benefit thereof. The International Application claims the benefits of European application No. 05015350.1 filed Jul. 14, 2005, both of the applications are incorporated by reference herein in their entirety.

FIELD OF INVENTION

The invention relates to a method for starting a steam turbine installation, which has at least one steam turbine and at least one steam generating installation for generating steam which drives the steam turbine, wherein the steam turbine installation has at least one reference component which at a starting time point has an initial temperature of more than 250° C., wherein the temperature of the steam and of the reference component is continuously measured, wherein the reference component of the steam turbine installation is impacted by steam from the starting time point onwards.

BACKGROUND OF THE INVENTION

For starting a steam turbine installation, the steam which is customarily generated in a waste heat steam generator is first of all not fed to the steam turbine section of a steam turbine installation, but is passed by the turbine via bypass stations and directly fed to a condenser which condenses the steam to water. The condensate is then fed again as feed water to the steam generator, or is blown out through a roof if there is no bypass station. Only when defined steam parameters in the steam lines of the water-steam cycle or in the steam lines which lead to the turbine section of the steam turbine installation, for example defined steam pressures and steam temperatures, are met, is the steam turbine brought onto line. Meeting these steam parameters is to keep possible stresses in thick-walled components at a low level and to avoid impermissible relative expansions.

If a steam turbine is stressed beyond a certain time at operating temperatures, the thick-walled components of the steam turbine, after overnight shutdowns or even after weekend shutdowns, still have high initial temperatures. Thick-walled components in this case for example are a valve housing, or a high pressure turbine section casing, or a high pressure or intermediate pressure shaft. After overnight shutdowns, which last about 8 hours, or after weekend shutdowns which last about 48 hours, the initial temperatures are typically between 300° and 500° C.

If the thick-walled components of a steam turbine installation, after a hot start or a warm start, i.e. after an overnight shutdown or a weekend shutdown, are impacted by the first available steam which the steam generator or boiler delivers, there is the risk of the thick-walled components being cooled too quickly, since as a rule the first steam has a comparatively low temperature compared with the thick-walled component.

Very large thermal stresses can result from the large temperature differences between the steam and the thick-walled components, which leads to fatigue of the material and consequently leads to a shortening of the service life.

Moreover, impermissibly high relative expansions can occur between the shaft and the casing, which can lead to a bridging of clearances.

In order to minimize the risk of excessively large temperature differences between the steam and the thick-walled components, which lead to large thermal stresses, the control valves in a steam turbine installation are currently kept closed until the steam generator or boiler delivers steam with correspondingly high temperature. These temperatures are about 50° C. above an initial temperature of individual thick-walled components. In this case, the long delay time until availability of the steam turbine installation is considered a disadvantage.

SUMMARY OF INVENTION

It is the object of the invention to disclose a method for starting a steam turbine installation of the type mentioned in the introduction, which leads to a quick availability of the steam turbine installation.

This object is achieved by means of a method for starting a steam turbine installation, which has at least one steam turbine and at least one steam generating installation for generating steam which drives the steam turbine, wherein the steam turbine installation has at least one reference component which at a starting time point has an initial temperature of more than 250° C., wherein the temperature of the steam and of the reference component is continuously measured, wherein the reference component of the steam turbine installation is impacted by steam from the starting time point onwards, wherein the starting temperature of the steam is lower than the temperature of the reference component, and the temperature of the steam is increased with a start transient, and the starting temperature and the start transient are selected in such a way that the temperature change per time unit of the reference component is below a predetermined limiting value, wherein the temperature of the reference component first of all becomes lower until a minimum is reached, and then becomes higher. The temperature change per time unit of the reference component in this case is with values which are greater than or equal to 5K/min.

The invention starts from the knowledge that the thick-walled components of a steam turbine installation, despite the high initial temperatures in comparison with the temperature of the steam, can be impacted by steam, the temperature of which is below the initial temperature of individual reference components. For this purpose, the temperature of the steam must be increased with an adequate transient so that the mean integral temperature of the thick-walled reference components experience only a negligibly low cooling down. A change, especially a temperature change, per time unit (° K/min) is to be understood by a transient, whereas a change, especially a temperature change per distance (° K/min) is to be understood by a gradient. As a result, relative expansion problems can also be excluded. The invention, therefore, starts from the knowledge that a very quick starting time of the steam turbine installation is possible even if the demand for steam from the steam generator or boiler, which is about 50 Kelvin above the initial temperature of the reference components, is dispensed with, and is impacted by steam, the temperature of which is below the initial temperature of the reference components. However, the initial temperature of the steam, after impaction upon the reference components, has to be increased with an adequate and suitable start gradient.

Too low a start gradient would lead to too low an increase of the temperature of the steam, and consequently there is the risk of the thick-walled components cooling down too much.

In one advantageous development, the temperature of the reference component is measured on a surface of it which faces the steam. A reference component first of all cools down naturally on the surface, and the components which lie further inside cool down comparatively slowly. This leads to a temperature difference in the thickness of the reference components, which can lead to thermal stresses. It is advantageous, therefore, if the temperature of the component is measured directly on the surface which faces the steam.

In a further advantageous development, the method is expanded to the effect that an additional temperature is measured at a point of the reference component which faces away from the steam, wherein the initial temperature and the start gradient are selected in such a way that a temperature difference between the temperature on the surface and the additional temperature is below a predetermined temperature difference limiting value.

The invention starts from the knowledge that even a high temperature difference between the temperature of the surface of a reference component and the temperature at an adjacent point of the reference component is detrimental. By measuring two temperatures on a reference component, wherein the one temperature is measured on the surface which faces the steam, and the other temperature is measured at a point which faces away from the steam, there is immediately the possibility of recording the emerging temperature difference in order to adopt suitable measures, i.e. to adjust the start transient of the steam if required.

The additional temperature is ideally measured on a surface of the reference component which lies opposite the surface which is impacted by the steam.

In a further advantageous development, the additional temperature is basically measured in the middle of the reference component. Since the thick-walled reference components of the steam turbine installation behave in a relatively delayed manner during a temperature increase, which means that the temperature increase in the wall thickness direction takes place very slowly, it is advantageous if the additional temperature is basically measured in the middle of the reference component. Consequently, a very early monitoring of the temperature development of the thick-walled reference components is possible.

In a further advantageous development, the start transient is selected in such a way that its value is greater than or equal to 5K/min. The value can be constant or variable. Consequently, it is possible to start a steam turbine installation with relatively simple process engineering means.

In a further advantageous development of the invention, the temperature of the steam, after reaching an acceptance limiting value, is increased with a reference gradient, wherein the value of the reference gradient is lower than the value of the start gradient. In this case, the invention starts from the idea that first of all steam, which is cooler in comparison to the initial temperature of the reference component, impacts upon the reference component. This leads to a cooling down of the surface of the reference component which faces the steam. The starting temperature of the steam in this case should not be too low compared with the starting temperature of the reference component. Also, the increasing of the temperature of the steam must be carried out with a suitable transient. Too slow an increase of the temperature of the steam leads to damage of the reference components. The thick-walled reference component first of all cools down until the temperature of the reference component reaches a minimum. After reaching this minimum, the temperature of the reference component is increased. The temperature of the steam is then increased with the start transient up to an acceptance limiting value. After reaching the acceptance limiting value, the temperature of the steam is further increased with a reference transient, wherein the value of the reference transient is lower than the value of the start transient. Too quick an increasing of the temperature of the steam would lead to the surface which faces the steam being heated up too quickly compared with the surface of the reference component which faces away from the steam, and consequently leads to too large a temperature difference between the surface which faces the steam and surface which faces away from the steam. This leads to unwanted damage of the reference component. By the selection of a suitable reference transient, which must be lower than the start transient, a development of too large a temperature difference between the side which faces the steam and the side which faces away from the steam is prevented.

In a further advantageous development, the change of temperature of the steam is carried out by means of external water injection. Consequently, a comparatively simple possibility is provided of influencing the transient of the temperature increase.

The initial temperatures of the reference components are advantageously between 300° C. and 450° C. The starting temperature of the steam is advantageously up to 150° C. below the initial temperature. In an advantageous development, the value of the start transient is greater than or equal to 5 Kelvin per minute, and is especially 13 Kelvin per minute. According to a further advantageous development, the value of the reference transient is between 0 and 15 Kelvin per minute, and the value is especially 1 Kelvin per minute. The inventor has recognized that these values are suitable in today's steam turbine construction in order to implement the method which is further described above.

BRIEF DESCRIPTION OF THE DRAWINGS

Exemplary embodiments of the invention are described with reference to the description and to the figures. In this case, components which are provided with the same designations have the same principle of operation.

In the drawing.

DETAILED DESCRIPTION OF INVENTION

Figure 1:
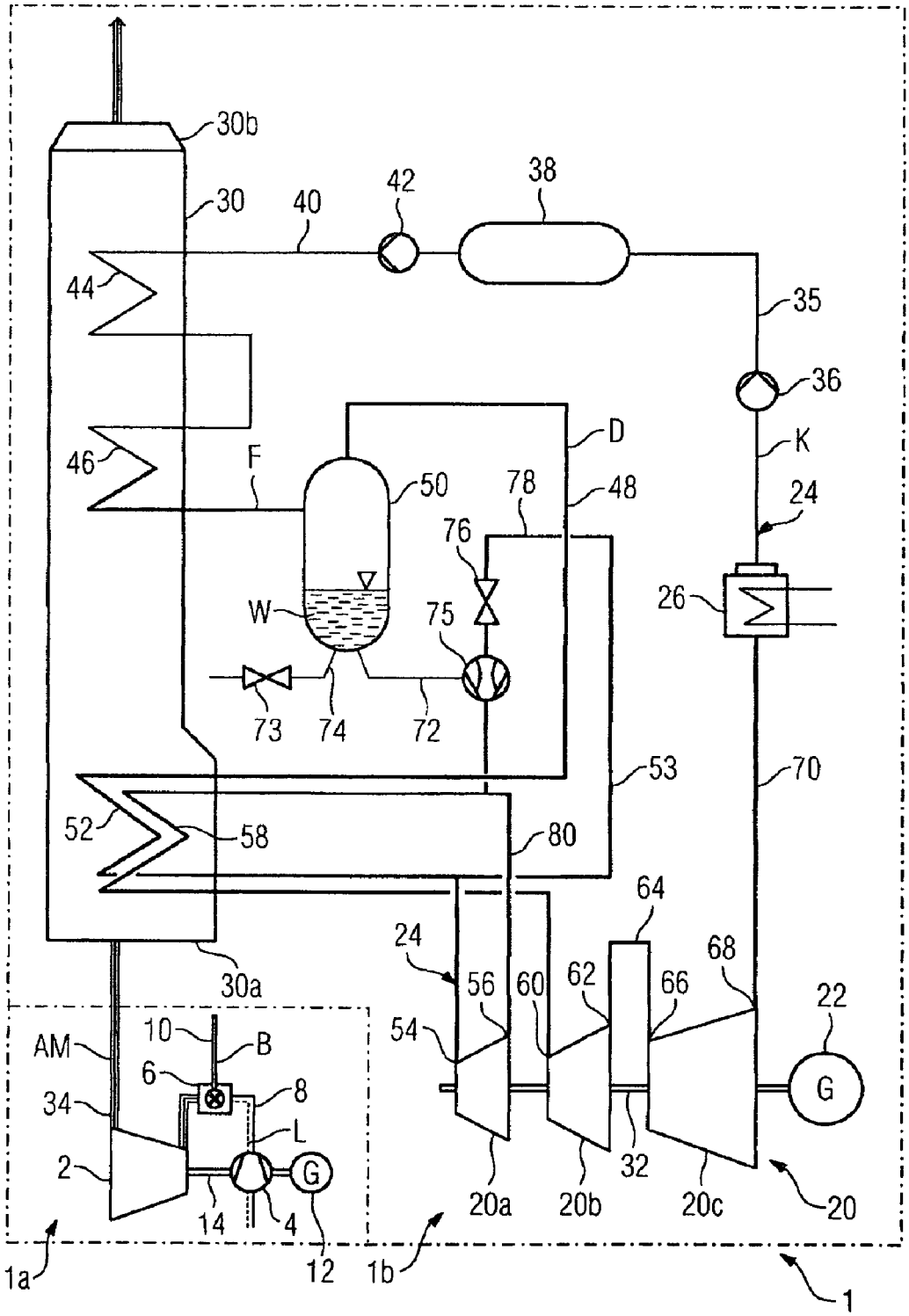
FIG. 1 shows a schematic representation of a gas and steam turbine installation.

The combined gas and steam turbine installation 1, which is schematically represented in FIG. 1, comprises a gas turbine installation 1*a* and also a steam turbine installation 1*b*. The gas turbine installation 1*a* is equipped with a gas turbine 2, a compressor 4 and also at least one combustion chamber 6 which is connected between the compressor 4 and the gas turbine 2. By means of the compressor 4, fresh air L is drawn in, compressed and, via the fresh air line 8, fed to one or more burners of the combustion chamber 6. The air which is fed is mixed with liquid fuel or gaseous fuel B which is fed via a fuel line 10, and the mixture is combusted. The combustion exhaust gases, which result in the process, form the working medium AM of the gas turbine installation 1*a* which is fed to the gas turbine 2 where, expanding, it performs work and drives a shaft 14 which is coupled to the gas turbine 2. In addition to being coupled to the gas turbine 2, the shaft 14 is also coupled to the air compressor 4 and also to a generator 12 in order to drive the latter. The expanded working medium AM is discharged via an exhaust gas line 34 to a waste heat steam generator 30 of the steam turbine installation 1*b*. In the waste heat steam generator 30, the working medium, which is discharged from the gas turbine 1*a* at a temperature of about 500° to 600° C., is used for the producing and superheating of steam.

In addition to the waste heat steam generator 30, which can especially be formed as a forced flow system, the steam turbine plant 1*b* comprises a steam turbine 20 with turbine stages 20*a*, 20*b*, 20*c* and a condenser 26. The waste heat steam generator 30 and the condenser 26, together with condensate lines or feed water lines 35, 40, and also with steam lines 48, 53, 64, 70, 80, 100, form a steam system which together with the steam turbine 20 forms a water-steam cycle.

Water from a feed water tank 38 is fed by means of a feed water pump 42 to a high pressure preheater 44, which is also known as an economizer, and from there is transmitted to an evaporator 46 which is connected on the outlet side to the economizer 44 and designed for a continuous operation. The evaporator 46 in its turn is connected on the outlet side to a superheater 52 via a steam line 48 into which a water separator 50 is connected. The superheater 52 is connected on the outlet side via a steam line 43 to the steam inlet 54 of the high pressure stage 20*a* of the steam turbine 20.

In the high pressure stage 20*a* of the steam turbine 20, the steam which is superheated by the superheater 52 drives the steam turbine before it is transferred via the steam outlet 56 of the high pressure stage 20*a* to a reheater 58.

After the superheating in the reheater 58, the steam is transmitted via a further steam line 81 to the steam inlet 60 of the intermediate pressure stage 20*b* of the steam turbine 20, where it drives the turbine.

The steam outlet 62 of the intermediate pressure stage 20*b* is connected via a crossover line 64 to the steam inlet 66 of the low pressure stage 20*c* of the steam turbine 20. After flowing through the low pressure stage 20*c* and the drives of the turbine which are connected to it, the cooled and expanded steam is discharged via the steam outlet 68 of the low pressure stage 20*c* to the steam line 70 which leads it to the condenser 26.

The condenser 26 converts the incoming steam into condensate and transfers the condensate via the condensate line 35, by means of a condensate pump 36, to the feed water tank 38.

In addition to the elements of the water-steam cycle which are already mentioned, the latter also comprises a bypass line 100, the so-called high pressure bypass line, which branches from the steam line 53, before this line reaches the steam inlet 54 of the high pressure stage 20*a*. The high pressure bypass line 100 bypasses the high pressure stage 20*a* and leads into the feed line 80 to the reheater 58. A further bypass line, the so-called intermediate pressure bypass line 200, branches from the steam line 81 before this line leads into the steam inlet 60 of the intermediate pressure stage 20*b*. The intermediate pressure bypass line 200 bypasses both the intermediate pressure stage 20*b* and the low pressure stage 20*c*, and leads into the steam line 70 which leads to the condenser 26.

A shut-off valve 102, 202 is built into the high pressure bypass line 100 and the intermediate pressure bypass line 200, by which they can be shut off. In the same way, shut-off valves 104, 204 are located in the steam line 53 or in the steam line 81, specifically between the branch point of the bypass line 100 or 200 and the steam inlet 54 of the high pressure stage 20*a* or the steam inlet 60 of the intermediate pressure stage 20*a* respectively.

A shut-off valve is located in the steam line 53, specifically between the branch point of the bypass line 100 and the steam inlet 54 of the high pressure stage 20*a* of the steam turbine 20.

The bypass line 100 and the shut-off valves 102, 104 serve for bypassing some of the steam for bypassing the steam turbine 2 during the starting of the gas and steam turbine installation 1.

At the beginning of the method, the steam turbine installation 1*b* is in a cooled down state and a hot or warm start is to be carried out. A start after an overnight shutdown of about 8 hours is typically referred to as a hot start, whereas a start after a weekend shutdown of about 48 hours is referred to as a warm start. The thick-walled components of the steam turbine 1*b* in this case still have high initial temperatures of 300° to about 500° C. The thick-walled components can also be referred to as reference components. In this case, thick-walled components for example are valve housings and high pressure casings, high pressure and intermediate pressure shafts. However, other thick-walled components are also conceivable.

At least at a starting time point, the reference component has an initial temperature of more than 250° C. In one method step, the temperature of the steam and of the reference component is continuously measured. The steam turbine installation 1*b* is impacted by steam from a starting time point onwards.

The starting temperature of the steam in this case is lower than the temperature of the reference component. The temperature of the steam is then increased with a controllable start transient, wherein the starting temperature and the start transient are selected in such a way that the temperature change per time unit of the reference component is below a predetermined limiting value, wherein the temperature of the reference component first of all becomes lower until a minimum is reached, and then becomes higher.

Figure 2:
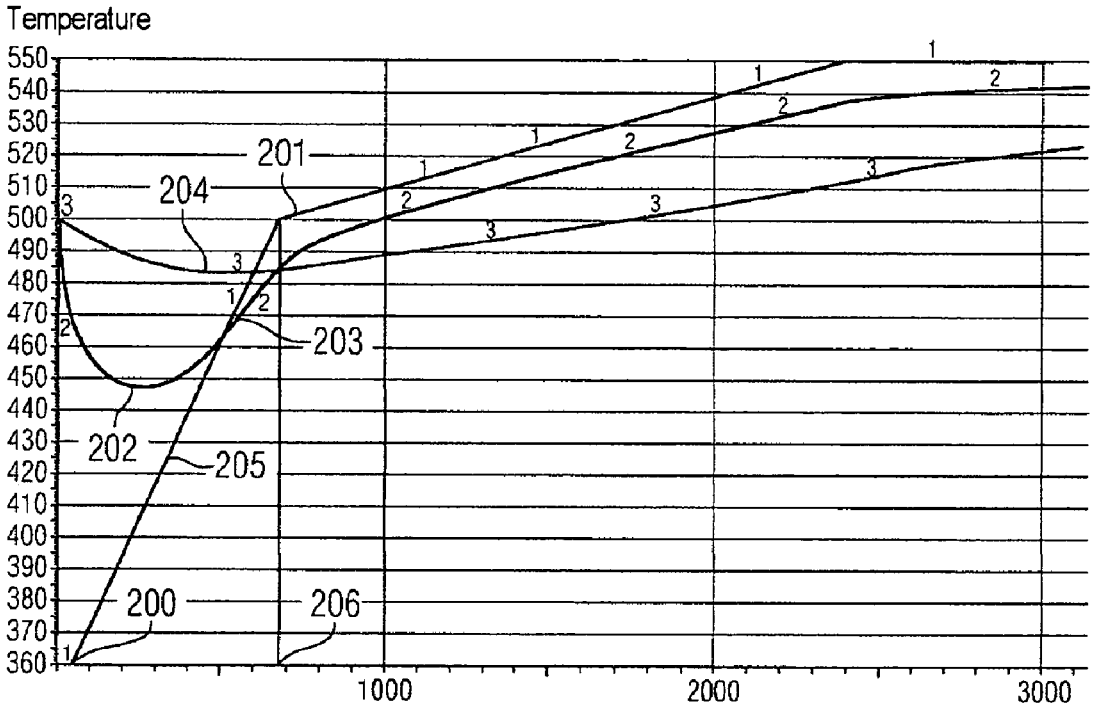
FIG. 2 shows a graphic representation of the temperature increases.

In FIG. 2, the temperature pattern of the steam 205 in dependence upon time is shown. The temperature pattern on a surface 202 of a thick-walled component which faces the steam is also shown. A mean integral temperature 204 of the thick-walled component is also shown in FIG. 2.

For example the temperature which basically prevails in the middle of the reference component is meant by the mean integral temperature 204.

After the starting time point 200, the temperature of the steam 205 is increased with a start transient which, as shown in FIG. 2, is constant. The constant start transient leads to a linear progression of the temperature up to an acceptance limiting value 201. From the acceptance limiting value 201 onwards, the increasing of the temperature of the steam 205 is carried out with a reference transient which is lower than the value of the start transient. The initial temperature of the thick-walled reference component has a value of more than 250° C., and in this exemplary embodiment is about 500° C. As a result of the impacting of the thick-walled component by steam, the temperature of which is lower than the temperature of the thick-walled component, the temperature of the surface of the thick-walled component first of all becomes lower until a minimum value 202 is reached. After this minimum 202, the temperature of the thick-walled component becomes higher and rises comparatively sharply up to the time point 206 at which the temperature of the steam reaches the acceptance limiting value, and is then more moderately increased with the reference transient. For this purpose, the temperature of the steam can be influenced by means of water injection.

The mean integral temperature 204 of the reference component principally follows the same pattern as the curve of the thick-walled component, which curve is identified by 203. First of all, the temperature drops until a minimum value 204 is reached. Then the temperature rises.

Figure 3:
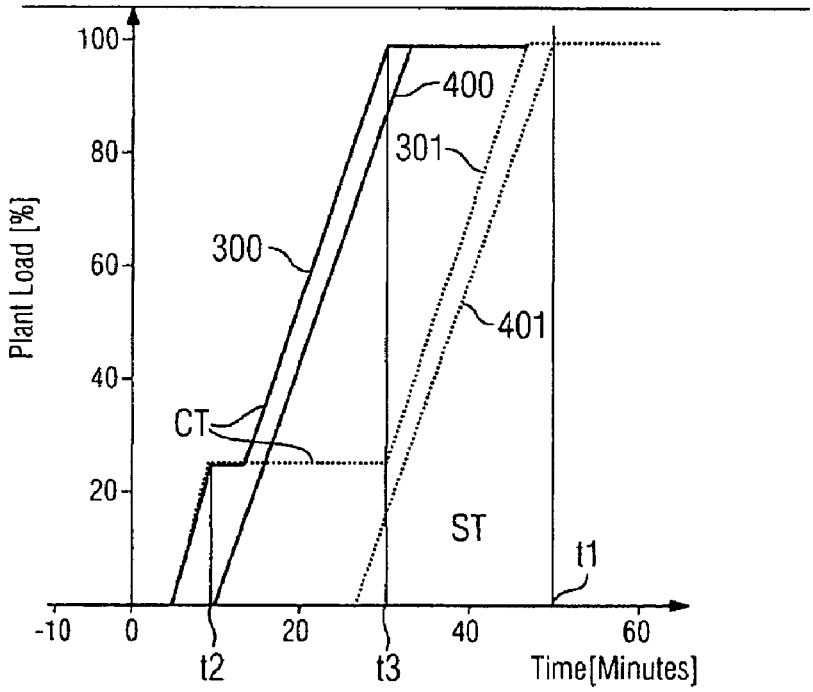
FIG. 3 shows a time development of the availability rate of the steam turbine.

In FIG. 3, the availability or power output of such a gas and steam turbine installation according to the invention is to be seen. The curve which is represented in dotted fashion shows the characteristic of a conventional gas and steam turbine installation 2 which exists according to the prior art. The continuous lines show the characteristic of a gas and steam turbine installation which was started by the method according to the invention. The time is plotted on the X-axis and the availability or the power output of the steam turbine installation in percent is plotted on the Y-axis. The curves 300 and 301 show the characteristic for a gas turbine installation (CT=Combustion Turbine), and the curves 400 and 401 show the characteristic for a steam turbine installation (ST=Steam Turbine). It is to be seen that with a conventional gas and steam turbine installation an availability of 30% is achieved relatively early, but a 100% availability is achieved only after a time t1, which in the selected example is about 50 minutes. With the installation according to the invention, there is also an availability of about 30% relatively early, specifically at a time point t2 which is about 10 minutes. There is a 100% availability in this case, however, only after a time point t3, which in the selected example is about 30 minutes.

The invention claimed is:

1. A method for starting a steam turbine installation having a steam turbine and a steam generating installation for generating steam that drives the steam turbine, comprising:

providing a reference component having an initial temperature of more than 250° C. at a starting time point, wherein the temperature of the reference component decreases until a minimum is reached that is more than 250° C., and then becomes higher;

continuously measuring the temperature of the steam and of the reference component;

impacting the reference component of the steam turbine installation with steam from the starting time point onwards, wherein the starting temperature of the steam is lower than the temperature of the reference component; and increasing the steam temperature with a start transient from the starting time point onwards where the starting temperature and the start transient are selected in such a way that the temperature change per unit time of the reference component is below a predetermined limiting value.

2. The method as claimed in claim 1, wherein the temperature of the reference component is measured on its surface which faces the steam.

3. The method as claimed in claim 2, wherein an additional temperature is measured at a point of the reference component which faces away from the steam, the starting temperature and the start transient are selected such that a temperature difference between the temperature on the surface and the additional temperature is below a predetermined temperature difference limiting value.

4. The method as claimed in claim 3, wherein the additional temperature is measured on a surface of the reference component which lies opposite the surface which is impacted by steam.

5. The method as claimed in claim 3, wherein the additional temperature is measured in the middle of the thickness of the reference component.

6. The method as claimed in claim 5, wherein the start transient is constant.

7. The method as claimed in claim 6, wherein the temperature of the steam, after reaching an acceptance limiting value, is increased with a reference transient, wherein the value of the reference transient is lower than the value of the start transient, and wherein the temperature of the steam upon reaching the acceptance limiting value is greater than the temperature of the reference component.

8. The method as claimed in claim 7, wherein the change of temperature of the steam is achieved via water injection.

9. The method as claimed in claim 8, wherein the initial temperatures of the reference components are between 300° C. and 400° C.

10. The method as claimed in claim 9, wherein the starting temperature of the steam is up to 150 K below the initial temperature.

11. The method as claimed in claim 10, wherein the start transient is greater than or equal to 5 K/min.

12. The method as claimed in claim 11, wherein the start transient is greater than or equal to 13 K/min.

13. The method as claimed in claim 12, wherein the reference transient is between 0 and 15 K/min.

14. The method as claimed in claim 13, wherein the reference transient is 1 K/min.

* * * * *